US010114320B2

(12) United States Patent
Takemoto

(10) Patent No.: US 10,114,320 B2
(45) Date of Patent: Oct. 30, 2018

(54) FIXING DEVICE AND IMAGE FORMING APPARATUS

(71) Applicant: KYOCERA Document Solutions Inc., Osaka (JP)

(72) Inventor: Mitsutoshi Takemoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/819,766

(22) Filed: Nov. 21, 2017

(65) Prior Publication Data

US 2018/0150007 A1 May 31, 2018

(30) Foreign Application Priority Data

Nov. 28, 2016 (JP) ..... 2016-230237

(51) Int. Cl.
*G03G 15/20* (2006.01)

(52) U.S. Cl.
CPC ..... *G03G 15/2064* (2013.01); *G03G 15/206* (2013.01)

(58) Field of Classification Search
CPC ..... G03G 15/2067; G03G 15/2089; G03G 15/206; G03G 15/2064
See application file for complete search history.

(56) References Cited

U.S. PATENT DOCUMENTS

2016/0291514 A1* 10/2016 Fukunaga ..... G03G 15/2067
2017/0205743 A1* 7/2017 Kamiya ..... G03G 15/2053
2018/0011436 A1* 1/2018 Sato ..... G03G 15/2067

FOREIGN PATENT DOCUMENTS

JP 2014-048597 A 3/2014
JP 2014-199386 A * 10/2014

* cited by examiner

*Primary Examiner* — Sophia S Chen
(74) *Attorney, Agent, or Firm* — Studebaker & Brackett PC

(57) ABSTRACT

A fixing device includes a heating body, a pressuring body, a lateral plate supporting the heating body or the pressuring body, a first supporting body supporting the heating or pressuring body, a second supporting body including a roller, a tensile spring connected between the first and second supporting bodies, an eccentric cam and a driving part. The first and the second supporting body are swingable to the lateral plate. The eccentric cam is supported between the first and second supporting bodies in the lateral plate, and is rotated while contacting with the roller to change the second supporting body, thereby changing a nip pressure of the first and second supporting bodies to a first pressure or a second pressure lower than the first pressure. In the eccentric cam, between first and second portions making the first and second pressures, at least one depression receiving insertion of the roller is formed.

10 Claims, 13 Drawing Sheets

Related Art

FIXING DEVICE AND IMAGE FORMING APPARATUS

INCORPORATION BY REFERENCE

This application is based on and claims the benefit of priority from Japanese Patent application No. 2016-230237 filed on Nov. 28, 2016, the entire contents of which are incorporated herein by reference.

BACKGROUND

The present disclosure relates to a fixing device and an image forming apparatus.

For example, it is known that a fixing device includes a fixing film, a pressuring roller and a pressure releasing means releasing a pressure contact state of the fixing film and the pressuring roller. The pressure releasing means has a driving member, a following member (an eccentric cam) and a buffering member. The driving member is driven and rotated by a driving means. The following member is rotatable with a rotating shaft of the driving member, follows with respect to the driving member with a predetermined play in a rotation direction, and has a cam face releasing the pressure contact state of the fixing film and the pressuring roller. The buffering member controls the predetermined play between the driving member and the following member in the rotation direction. Moreover, the following member has a gap into which the driving member and the buffering member are fitted with predetermined play in the rotation direction.

The above-mentioned fixing device may reduce impulsive sound occurring in accordance with overrunning of the following member, but cannot restrain overrunning of the following member.

SUMMARY

In accordance with the present disclosure, a fixing device includes a heating body, a pressuring body, a lateral plate, a first supporting body, a second supporting body, a tensile spring, an eccentric cam, and a driving part. The heating body is rotated and heats a medium on which a toner image is formed. The pressuring body forms a nip with the heating roller, is rotated and pressures the medium passing through the nip. The lateral plate supports one body of the heating body and the pressuring body rotatably. The first supporting body is swingably supported to the lateral plate and supports other body being against the one body rotatably. The second supporting body is swingably supported to the lateral plate and includes a rotatable roller. The tensile spring is connected between the first supporting body and the second supporting body at its both ends to pull the first supporting body to a side of the second supporting body. The eccentric cam is rotatably supported at a position between the first supporting body and the second supporting body in the lateral plate, makes its outer circumference face come into contact with the roller, and is rotated to change a posture of the second supporting body and to extend and contract the tensile spring, and thereby, changes a nip pressure of the nip to a first pressure or a second pressure lower than the first pressure. The driving part includes a gear train connected to the eccentric cam to transmit torque rotating the eccentric cam to the eccentric cam and a driving source driving the gear train. In the outer circumference face, in a portion coming into contact with the roller between a first portion making the first pressure of the nip pressure and a second portion making the second pressure of the nip pressure, at least one depression receiving insertion of the roller is formed.

In accordance with the present disclosure, an image forming apparatus includes a forming part forming a toner image onto a medium; and the above-described fixing device fixing the toner image formed on the medium by the forming part to the medium.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
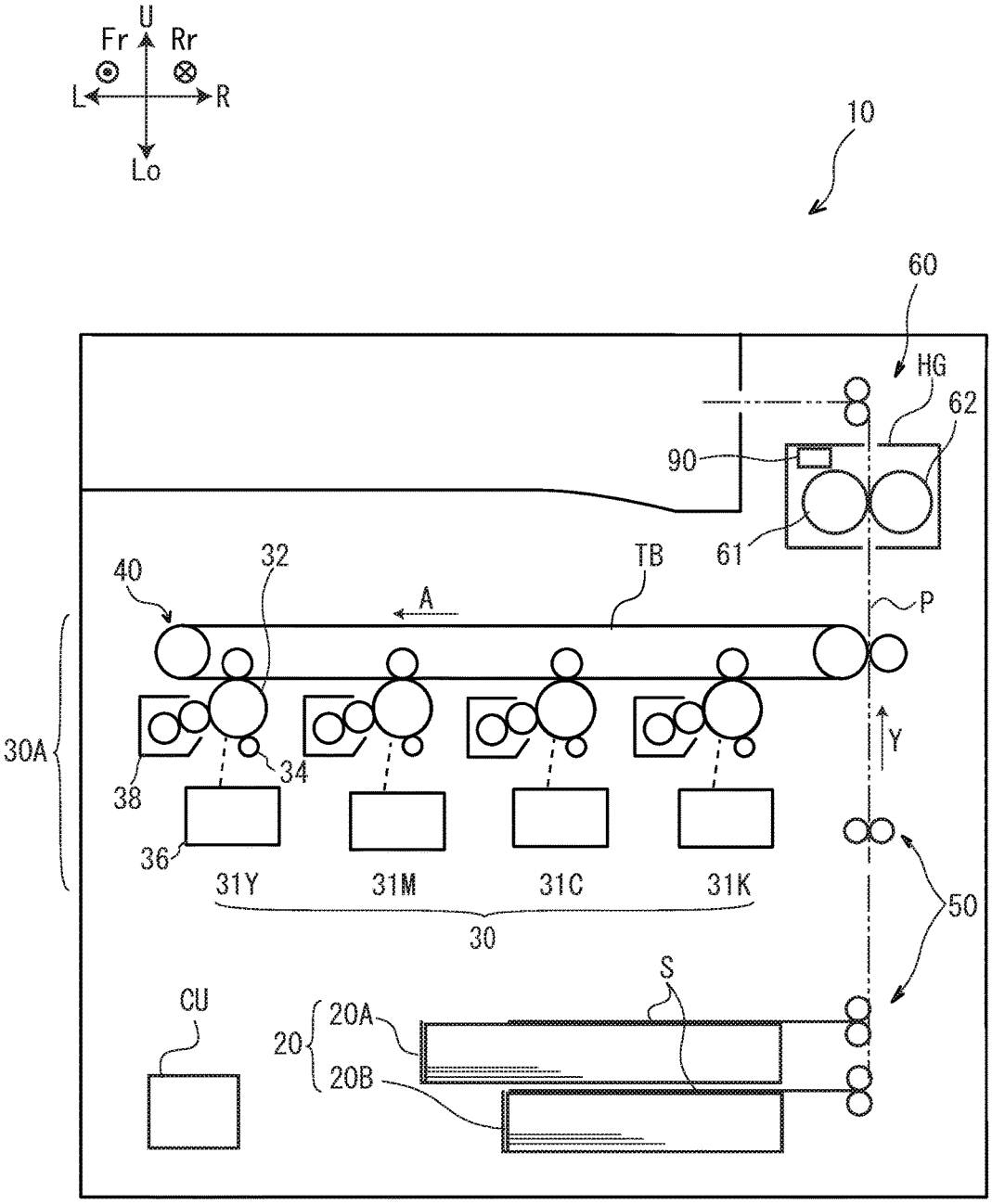
FIG. 1 is a front sectional view schematically showing an image forming apparatus according to an embodiment of the present disclosure.

Hereinafter, entire structure of an image forming apparatus 10 (refer to FIG. 1) according to an embodiment and image forming operation of the image forming apparatus 10 will be described with reference to the drawings. In addition, structure of a fixing device 60 (refer to FIGS. 3-9) as a main component of the embodiment and changing operation of a nip pressure of the fixing device 60 will be described with reference to the drawings. The changing operation of the nip pressure is operation for changing the nip pressure between a heating roller 61 and a pressuring roller 62 composing the fixing device 60 when the image forming operation is carried out in the image forming apparatus 10. Furthermore, effects of the embodiment will be described with reference to the drawings.

In the following description, arrows Fr and Rr in the drawings respectively correspond to a near side and a far side in an apparatus depth direction, arrows R and L in the drawings respectively correspond to a right side and a left side in an apparatus width direction, and arrows U and Lo in the drawings respectively correspond to an upper side and a lower side in an apparatus height direction. The specification will be described so that a state of the image forming apparatus 10 as viewed from the near side in the apparatus depth direction is estimated to be a front side of the image forming apparatus 10.

Firstly, the entire structure of the image forming apparatus 10 will be described. The image forming apparatus 10 is an electrographic type apparatus configured to, as shown in FIG. 1, include a sheet feeding cartridge 20, a toner image forming part 30, a transferring device 40, a conveying device 50, a fixing device 60 and controlling part CU.

The sheet feeding cartridge 20 has a function containing a so-called plain paper, an envelope and other mediums S. The sheet feeding cartridge 20 is located at a lower side inside the image forming apparatus 10 in the apparatus height direction. The sheet feeding cartridge 20 is composed of, as one example, a first sheet feeding cartridge 20A and a second sheet feeding cartridge 20B. The first sheet feeding cartridge 20A contains the plain paper and the second sheet feeding cartridge 20B contains another cardboard (a thicker paper than the plain paper), such as the envelope. Moreover, containing of the plain paper in the first sheet feeding cartridge 20A and containing of the cardboard in the second sheet feeding cartridge 20B (hereinafter, called as containing information) are inputted from a user interface UI (refer to FIG. 10) provided in the image forming apparatus 10 by a worker, and then, stored in a storing part RAM (refer to FIG. 10) provided in the controlling part CU described later.

The toner image forming part 30 has a function carrying out respective steps of electric charging, exposing and developing to form a toner image carried on a belt TB described later. The toner image forming part 30 is composed of single color units 31Y, 31M, 31C and 31K respectively forming toner images of different colors (Y (yellow), M (magenta), C (cyan) and K (black)). Each of the single color units 31Y, 31M, 31C and 31K includes a photosensitive body 32, a charging device 34, an exposing device 36 and a developing device 38. Incidentally, in FIG. 1, reference signs of components of the single color units 31M, 31C and 31K other than the single color unit 31Y are omitted. Moreover, the toner image forming part is located at a center inside the image forming apparatus 10 in the apparatus height direction.

The transferring device 40 includes the endless belt TB and has a function primarily transferring the toner image formed by the toner image forming part 30 onto the rotating belt TB (in an arrow A direction in FIG. 1) and secondarily transferring the toner image carried on the belt TB onto the medium S. The transferring device 40 is located above the toner image forming part 30 and at the center inside the image forming apparatus 10 in the apparatus height direction.

The conveying device 50 has a function conveying the medium S contained in the sheet feeding cartridge 20 along a conveying path (a two-dot chain line P in FIG. 1). Incidentally, an arrow Y in FIG. 1 indicates a conveying direction of the medium S.

The fixing device 60 has a function fixing the toner image secondarily transferred on the medium S by the transferring device 40 onto the medium S. The fixing device 60 is located above the transferring device 40 in the apparatus height direction and at a right side as viewed from a front side of the image forming apparatus 10. The fixing device 60 will be described in detail later.

Figure 10:
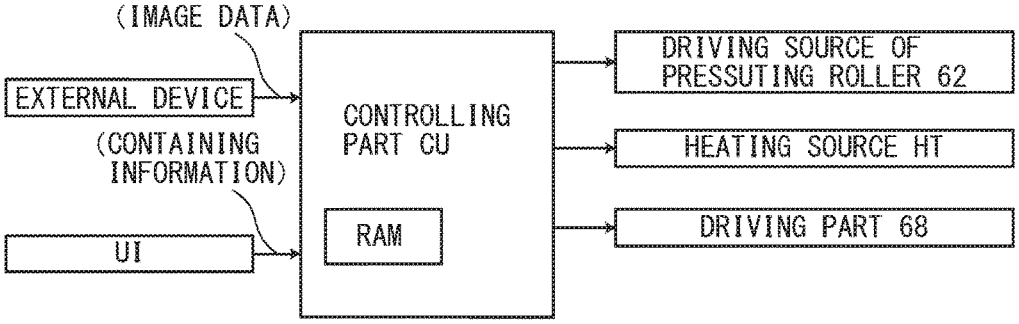
FIG. 10 is a block diagram showing a relationship of a controlling part composing the image forming apparatus and each component composing the fixing device according to the embodiment.

The controlling part CU has a function control each component composing the image forming apparatus 10 (refer to FIGS. 2 and 10 described later). The function of the controlling part CU will be described in the later description of image forming operation and changing operation of a nip pressure of the fixing device 60.

Each component of the image forming apparatus 10 was described above, and further, combination (hereinafter, called as a forming part 30A) of the toner image forming part 30 and the transferring device 40 can be regarded to have a function forming the toner image onto the medium S.

Next, the image forming operation of the image forming apparatus 10 of the embodiment will be described with reference to FIGS. 1 and 2.

The controlling part CU, when receiving image data from an external device (not shown) and receiving job data having data of the medium S as an image formed object and other data, operates each component of the image forming apparatus 10.

Figure 2:
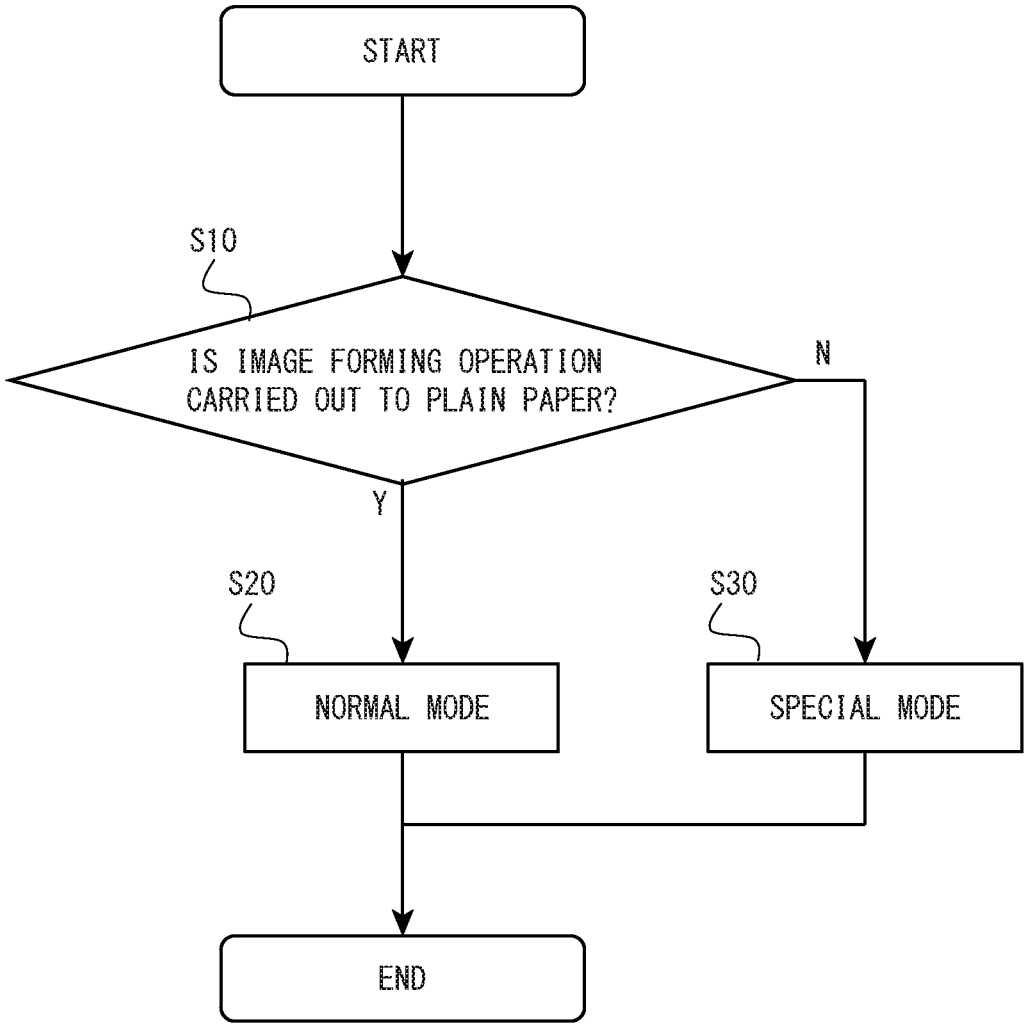
FIG. 2 is a chart showing a control flow of changing operation of a nip pressure between a heating roller and a pressuring roller of a fixing device in the image forming apparatus according to the embodiment.

Here, the controlling part CU, in accordance with a control flow shown in FIG. 2, decides at a decision step S10, whether or not the medium S as the image formed object is the plain paper. As a result, if decision of the controlling part CU is positive, the controlling part CU selects a normal mode at a step S20 to make the image forming apparatus 10 carry out the image forming operation using the plain paper contained in the first sheet feeding cartridge 20A. By contrast, if decision of the controlling part CU is negative, the controlling part CU selects a special mode at the step S30 to make the image forming apparatus 10 carry out the image forming operation using the envelope contained in the second sheet feeding cartridge 20B.

Then, when the toner image forming part 30 is operated, in each of the single color units 31Y, 31M, 31C and 31K, the charging device 34 electrically charges the photosensitive body 32, the exposing device 36 exposes the photosensitive body 32 to form a latent image on the photosensitive body 32, and the developing device 38 develops the latent image on the photosensitive body 32 to the toner image. As a result, the toner image is formed on the photosensitive body 32.

Subsequently, when the transferring device 40 and the conveying device 50 are operated, the toner image formed by the toner image forming part 30 is primarily transferred onto the belt TB. Moreover, at a timing when the toner image primarily transferred on the belt TB is secondarily transferred, the medium S contained in the sheet feeding cartridge 20 is conveyed by the conveying device 50, and then, the toner image carried by the belt TB is secondarily transferred onto the medium S. The medium S with the secondarily transferred toner image is conveyed to the fixing device 60 by the conveying device 50.

After that, when the fixing device 60 is operated and the medium S with the secondarily transferred toner image is conveyed to the fixing device 60, the toner image secondarily transferred on the medium S is fixed onto the medium S (the image is formed on the medium S).

Incidentally, the normal mode and the special mode are different in the nip pressure between the heating roller 61 and the pressuring roller 62 and its detail will be described in the description of the changing operation of the nip pressure of the fixing device 60.

Further, the medium S with the fixed toner image (the medium S on which the image is formed) is ejected to the outside of the image forming apparatus 10 by the conveying device 50, and then, the image forming operation is completed.

Next, the structure of the fixing device 60 as a main component of the embodiment will be described in detail with reference to FIGS. 3-9.

The fixing device 60 is configured to include a housing HG, the heating roller 61 (one example of a heating body), a heating source HT, the pressuring roller (one example of a pressuring body), lateral plates 63, first supporting bodies 64, coil springs CS, second supporting bodies 65, tensile springs ES, eccentric cams 66, a shaft 67 and a driving part 68. The housing HG, the heating roller 61, the heating source HT, the pressuring roller 62 and the shaft 67 have respective longitudinal sizes and are arranged in a state that respective longitudinal directions are parallel to the apparatus depth direction. Moreover, the fixing device 60 has a longitudinal size and is attached to a main body of the image forming apparatus 10 in a state that its longitudinal direction is parallel to the apparatus depth direction (refer to FIG. 1). Incidentally, the lateral plates 63, the first supporting bodies 64 and the second supporting bodies 65 are respectively paired at both end sides in the longitudinal direction of the image forming apparatus 10 (are configured as respective pairs).

The housing HG has a function housing components composing the fixing device 60 other than the housing HG in its inside. The housing HG is formed, as one example, in a rectangular shape as viewed from the front side of the image forming apparatus 10. At a lower side of the housing HG, an inlet HG1 is formed into which the medium S conveyed in the conveying path P by the conveying device 50 is inputted. At an upper side of the housing HG, an outlet HG2 is formed into which the medium S conveyed in the conveying path P by the conveying device 50 is outputted from the fixing device 60.

Figure 6:
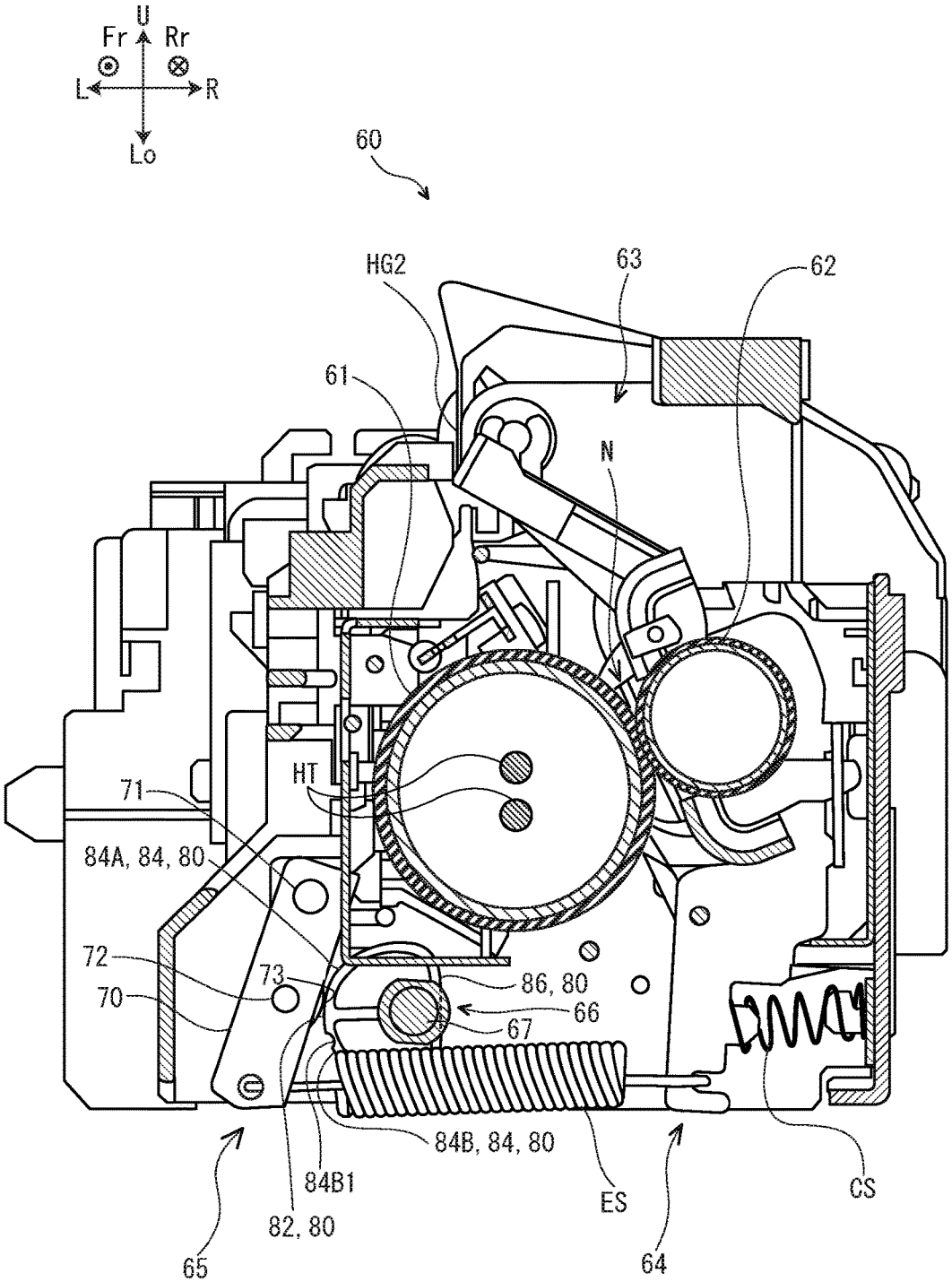
FIG. 6 is a partially sectional view (a sectional view as viewed from a longitudinal direction) showing the fixing device, in a normal mode, according to the embodiment.
Figure 7:
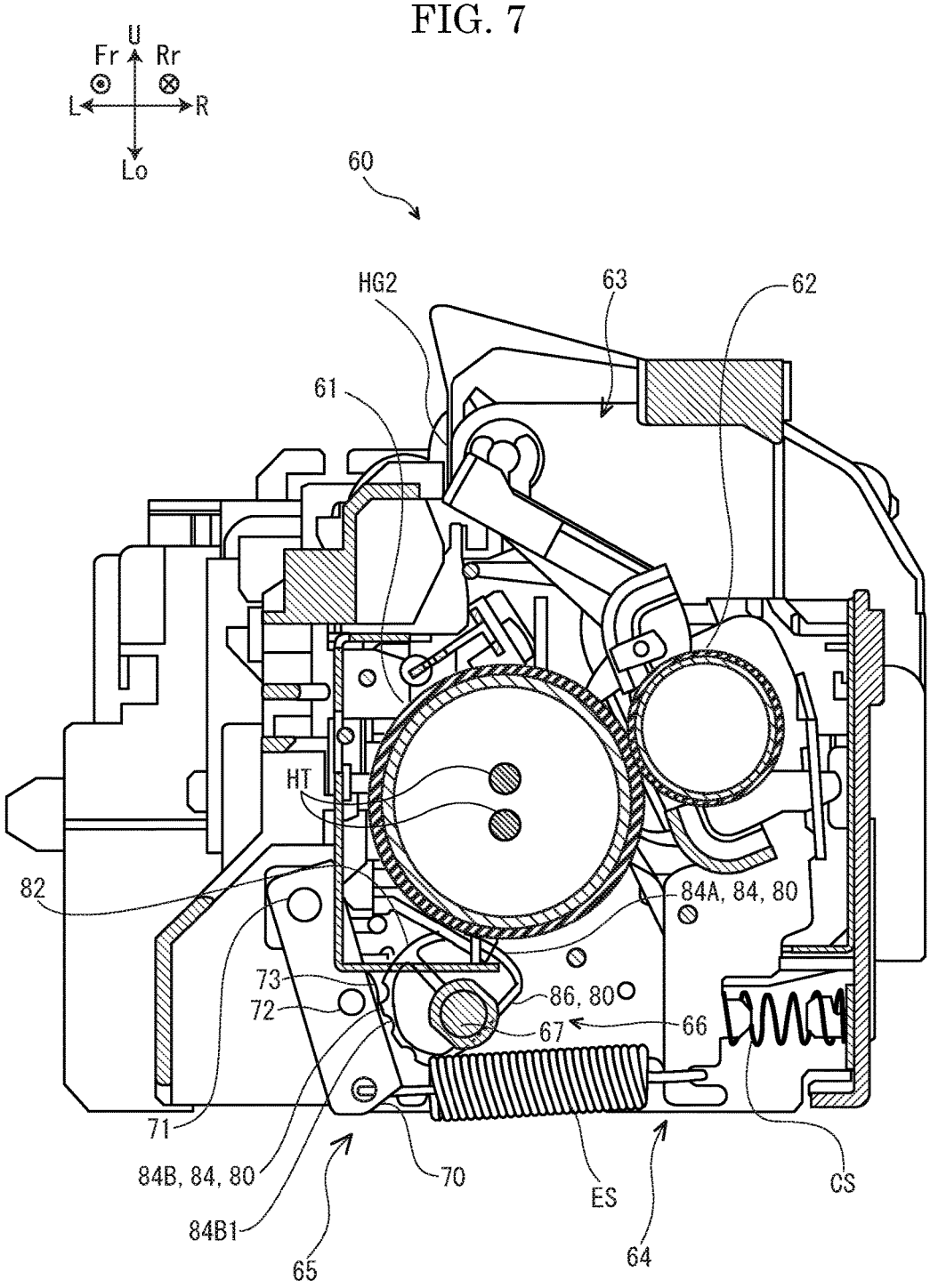
FIG. 7 is a sectional view as viewed from a longitudinal direction showing the fixing device, when the nip pressure is changed from the normal mode to a special mode or from the special mode to the normal mode, according to the embodiment.

The heating roller 61 has a function heating the toner image (a toner composing it) formed on the medium S by the forming part 30A and the medium S. The heating roller 61 is, as shown in FIGS. 6 and 7, a rubber roller in which an outer circumference of a metal pipe is coated by rubber. The heating roller 61 is located at a center of the fixing device 60 (a center in the housing HG) as viewed from a front side. The heating roller 61 is heated to a predetermined temperature by the heating source HT described later, and simultaneously, rotated by following to the pressuring roller 62 described later. Moreover, the heating roller 61 pressures, with the pressuring roller 62 at a nip N described later, the medium S having the formed toner image conveyed by the conveying device 50. As a result, the heating roller 61 rotates around an axis (rotated in a counter clockwise direction as viewed from the front side), and simultaneously, comes into contact with the medium S having the formed toner image to heat the medium S, and thereby, fixes the toner image onto the medium S passing through the nip N with the pressuring roller 62.

The heating source HT is, as one example, a halogen lamp. The heating source HT is, as shown in FIGS. 6 and 7, located inside the heating roller 61.

Incidentally, in parts at both ends of the heating roller 61, flanges (not shown) are fitted and fixed. Moreover, the respective flanges are rotatably supported to a pair of lateral plates 63 described later.

The pressuring roller 62 has a function pressuring, with the heating roller 61, the toner image (the toner composing it) formed by the toner image forming part 30 and secondarily transferred on the medium S by the transferring device 40 and the medium S, on other words, the toner image (the toner composing it) formed on the medium S by the forming part 30A (refer to FIG. 1) and the medium S. The pressuring roller 62 is a rubber roller in which an outer circumference of a metal shaft is coated by rubber. The pressuring roller 62 is, as shown in FIGS. 6 and 7, located at a right side of the heating roller 61 as viewed from a front side. Moreover, the pressuring roller comes into contact with the heating roller 61. Incidentally, the above nip N indicates a contact portion of the heating roller 61 and the pressuring roller 62 formed by the heating roller 61 and the pressuring roller 62.

To one end of the metal shaft of the pressuring roller 62, a driving source (not shown) is connected. Moreover, the pressuring roller 62 is driven by the driving source and rotated around an axis (rotated in a clockwise direction as viewed from the front side) to rotate the heating roller 61.

Figure 5:
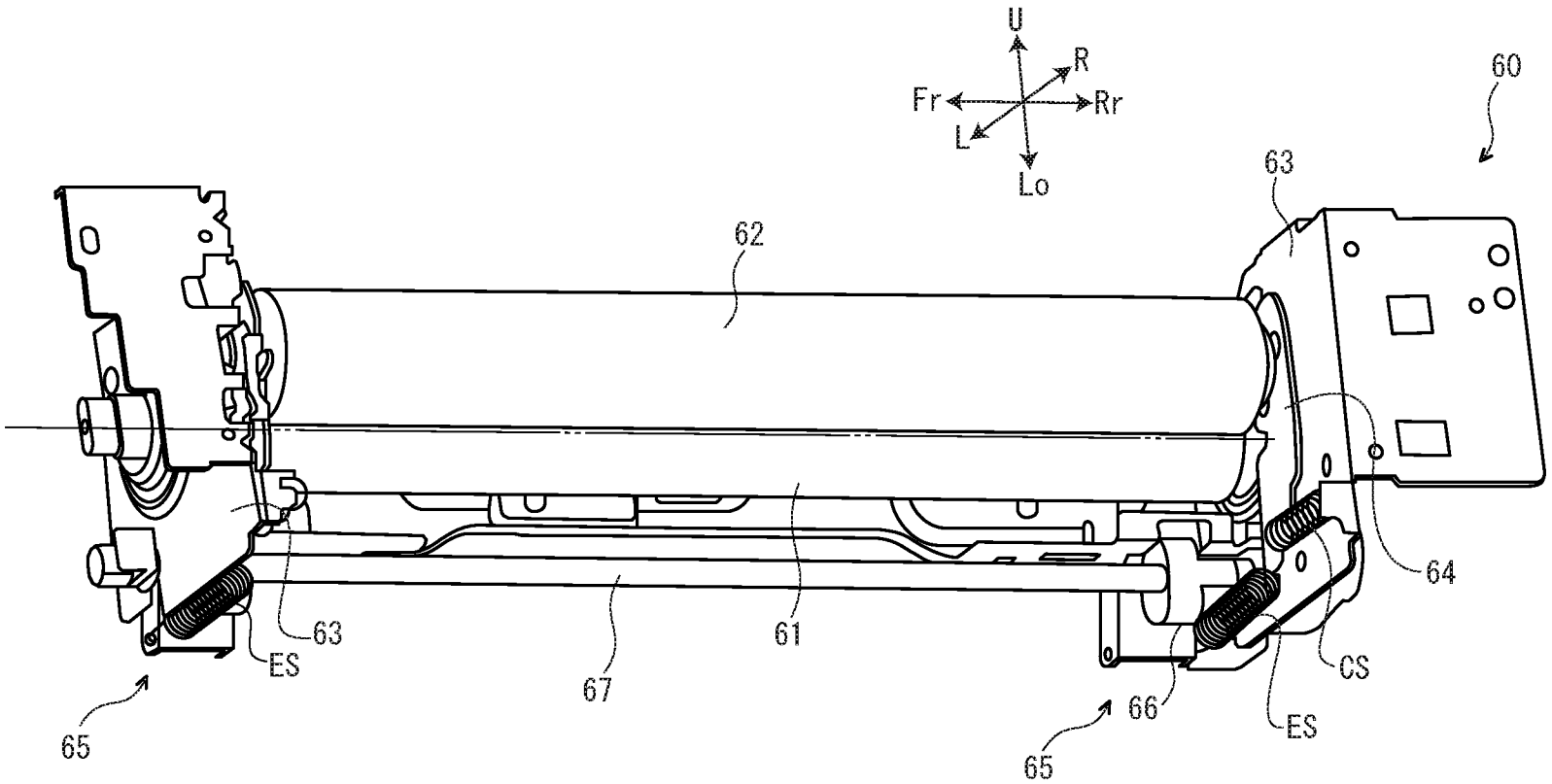
FIG. 5 is a perspective view showing the fixing device, in a state that a housing is detached (a state that the housing is removed), according to the embodiment.

The lateral plates 63 have, as shown in FIG. 5, a function supporting the heating roller 61 as being rotatable around the axis. Incidentally, as described above, in the lateral plates 63, through holes are formed and, into the through holes, the flanges fixed to both end sides of the heating roller 61 are fitted.

Figure 8:
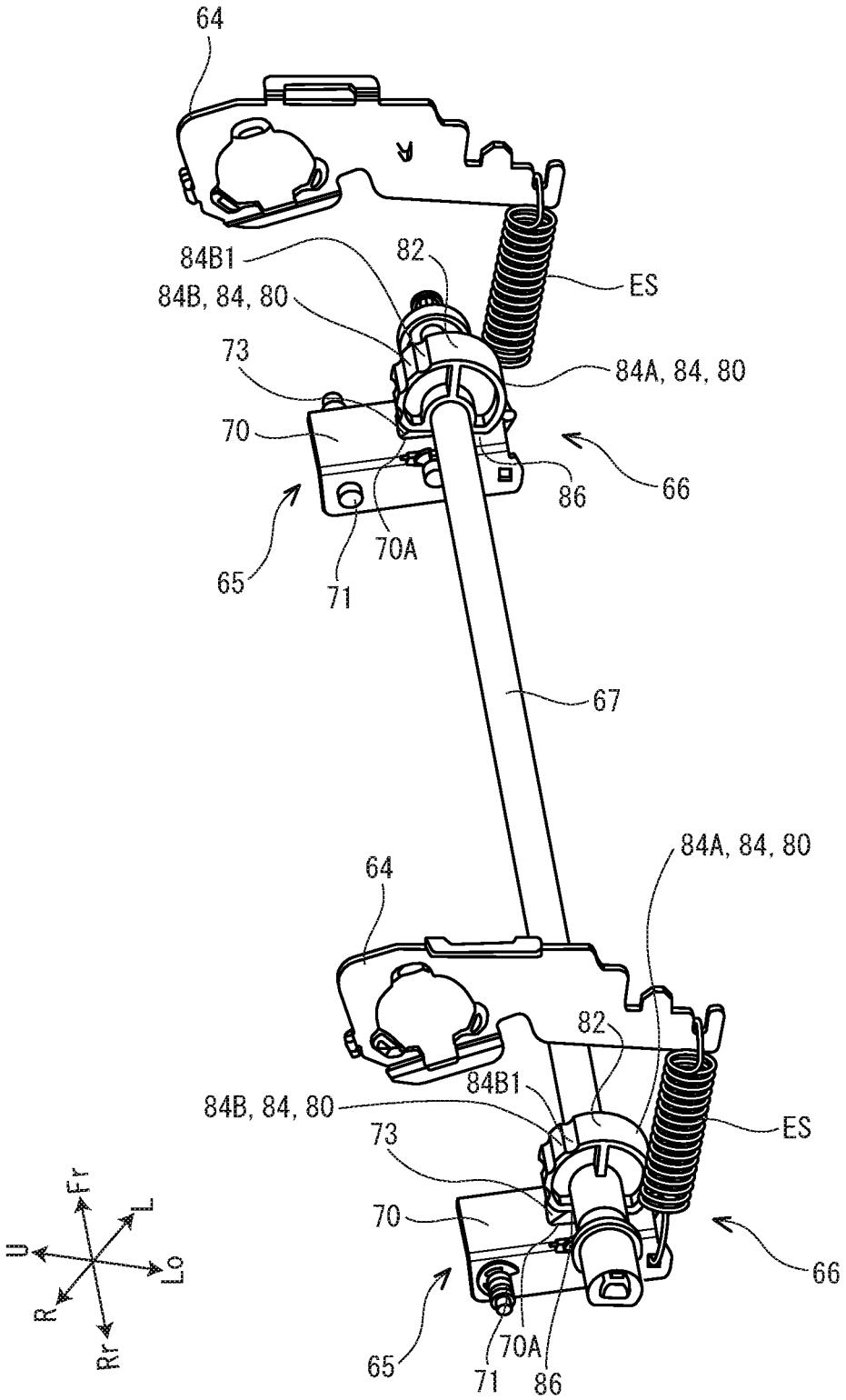
FIG. 8 is a perspective view showing an eccentric cam and peripheral components of the fixing device, in the special mode, according to the embodiment.

The first supporting bodies 64 have a function supporting the pressuring roller 62 as being rotatable around the axis. The first supporting bodies 64 are, as shown in FIGS. 6-8, made of longitudinal metal plates. Moreover, the first supporting bodies 64 are located at opposite sides to the heating roller 61 across the nip N. One end sides (upper sides) of the first supporting bodies are swingably supported to the through holes of the lateral plates 63 by pins. In addition, other end sides (lower sides) of the first supporting bodies 64, projections are formed. Then, the first supporting bodies 64 are pressed by the coil springs CS compressed by and fitted to the projections and protrusions of the lateral plates 63. As a result, the pressuring roller 62 supported by the first supporting bodies 64 comes into contact with the heating roller 61 to form the nip N (as shown in FIGS. 6 and 7). Incidentally, the respective first supporting bodies 64 are located at the inside of the pair of the lateral plates 63 (at facing sides of the pair of the lateral plates 63).

The second supporting bodies 65 are, as shown in FIGS. 6 and 7, located at opposite sides to the pressuring roller 62 across the nip N (or the heating roller 61) and at a lower side from the pressuring roller 62. The second supporting bodies 65 are configured to include cases 70, first pins 71, second pins 72 and rollers 73, respectively. On other words, each second supporting body 65 is provided with the roller 73.

The case 70 is, as shown in FIG. 8, a longitudinal member so that a cross section as viewed from a longitudinal direction is a U-shape. In one end side and a center side in a longitudinal direction of the case 70, through holes going through its facing walls are formed. Then, the case 70 is swingably supported to the lateral plate 63 by fitting the first pin 71 into the through hole at the one end side in the longitudinal direction and fitting the first pin 71 into the through hole formed in the lateral plate 63. Incidentally, at the center in the longitudinal direction in a wall connecting the facing walls of the case 70, a through hole 70A in a rectangular shape as viewed in a thickness direction of the wall is formed (refer to FIG. 8).

The second pin 72 is, as shown in FIGS. 6-8, fitted into the through hole formed at the center in the longitudinal direction of the case 70 and fixed in a state connecting the facing walls of the case 70. Moreover, at the center in a longitudinal direction of the second pin 72, the roller 73 is located as being rotatable around an axis. Incidentally, between the roller 73 and the facing walls of the case 70, as one example, a pair of coil springs (not shown) in compressed states are fitted to the second pin 72, but its illustration is omitted. Therefore, the roller 73 is pressed by the pair of coil springs to be positioned at the center in the longitudinal direction of the second pin 72.

The tensile springs ES are, as shown in FIGS. 6 and 7, suspended by parts in which through holes are formed at lower sides (opposite sides to fulcrum sides of swinging) of the first supporting bodies 64 and parts in which through holes are formed at lower sides (opposite sides to fulcrum sides of swinging by fitting the first pins 71) of the cases 70. On other words, both end sides of the tensile spring ES are connected to the first supporting body 64 and the second supporting body 65. Moreover, the tensile spring ES is extended more than its natural length in a situation in which the eccentric cam 66 described later comes into contact with the roller 73 of the second supporting body 65 and presses the roller 73. Therefore, the tensile spring ES pulls the first supporting body 64 to a side of the second supporting body 65.

The eccentric cams 66 have a function rotating around an axis to swing the second supporting bodies 65. On other words, the eccentric cam 66 has a function rotating around the axis to change a posture of the second supporting body 65 and to extend and contract the tensile spring ES. The eccentric cam 66 is fitted to an outer circumference of the shaft 67 and fixed to the outer circumference at both end sides of the shaft 67. The shaft 67 is, as shown in FIG. 5, fitted into the through holes formed in the pair of the lateral plates 63 to be rotatable around an axis. Then, each eccentric cam 66 is arranged, in a state supported by the shaft 67 at a position between the first supporting body 64 and the second supporting body 65 in each lateral plate 63, so that its outer circumference face 80 comes into contact with the roller 73 of each second supporting body 65.

Figure 9:
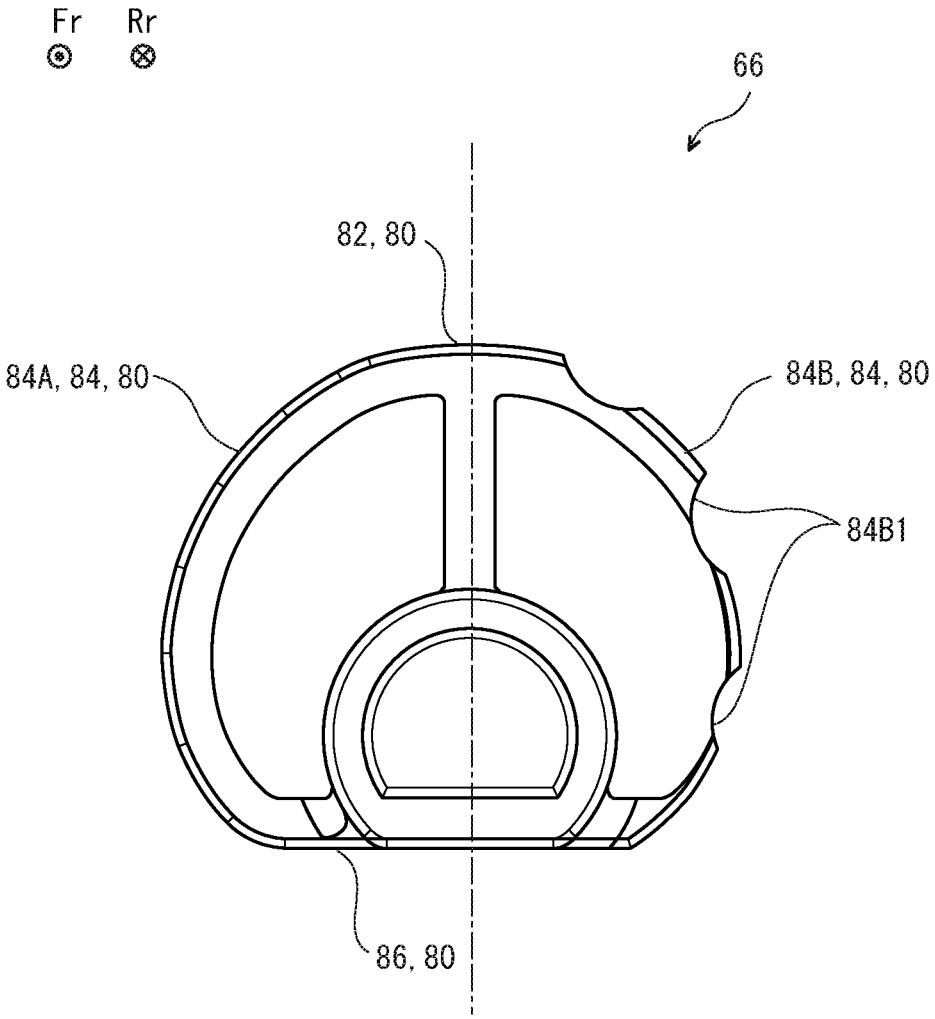
FIG. 9 is a front view showing the eccentric cam composing the fixing device according to the embodiment.

The eccentric cam 66 is, as shown in FIGS. 6-9, a member in a semi-elliptic shape as a portion cut out along a minor axis of an ellipse as viewed in an orthogonal direction (corresponding to an axis direction of the shaft 67) to its rotation direction. That is, the eccentric cam 66 is a line symmetry member as viewed in the orthogonal direction to its rotation direction and a portion (a one-dot chain line in FIG. 9) crossing a symmetry axis in the outer circumference face 80 and its peripheral portion (plus or minus 5 angles with respect to the symmetry axis) are arranged at a constant distance from a rotation axis of the eccentric cam 66. In the following description, the portion crossing the symmetry axis in the outer circumference face 80 and its peripheral portion (plus or minus 5 angles with respect to the symmetry axis) are called as a first face 82 (one example of a first portion making a first pressure described later of the nip pressure of the nip N). Moreover, portions from ends of the first face 82 to 90 angles with respect to the symmetry axis in the outer circumference face 80 are called as second faces 84. Further, a face other than the first face 82 and the second faces 84 in the outer circumference face 80, i.e. an opposite face to the first face 82 in a direction of the symmetry axis, is called as a third face 86 (one example of a second portion making a second pressure described later of the nip pressure of the nip N). The third face 86 is, as shown in FIG. 9, formed in a plain face.

The second faces 84 will be described as follows. One second face 84A of the pair of second faces 84 is, as shown in FIG. 9, is formed so that its distance from the rotation axis of the eccentric cam 66 is gradually shortened from a border with the first face 82 (one end at a side of the first face 82) to an opposite end, i.e. a border with the third face 86. By contrast, other second face 84B (one example of a portion coming into contact with the roller 73 between the first portion making the first pressure of the nip pressure and the second portion making the second pressure of the nip pressure) of the pair of second faces 84 is, as shown in FIG. 9, a face in which a plurality of depressions 84B1 (at least one depression) receiving insertion of a part (the roller 73) of the second supporting body 65 are formed on the second face 84A as being the line symmetry with respect to the symmetry axis. In the embodiment, the plurality of depressions 84B1 are, as one example, three. In the following description, as shown in FIG. 6, a state that the eccentric cam 66 comes into contact with the roller 73 by the first face 82 is an initial position of the eccentric cam 66. Moreover, as shown in FIG. 8, a state that the eccentric cam 66 comes into contact with the roller 73 by the third face 86 is a special position of the eccentric cam 66. In the specification, the nip pressure of the nip N in the initial position of the eccentric cam 66 is the first pressure and the nip pressure of the nip N in the special position of the eccentric cam 66 is the second pressure. The second pressure is set lower than the first pressure.

In the embodiment, when the shaft 67 is rotated around the axis by the driving part 68 described later, the eccentric cam 66 is rotated around the axis. In such a case, the shaft 67 is set so as to stop after rotating by 180 degrees in the clockwise direction as viewed from a front side with respect to a standard (zero agree) as being the initial position of the eccentric cam 66. Moreover, the eccentric cam 66 makes the second face 84B come into contact with the roller 73, and simultaneously, rotates around the axis during a period changing its posture from the initial position to the special position. That is, during the period changing the posture from the initial position to the special position, the eccentric cam 66 is rotated around the axis while making the roller 73 insert in the plurality of depressions 84B1 in order in the middle way of rotating and making the roller 73 come into contact with the second face 84B. Therefore, during the period changing the posture of the eccentric cam 66 from the initial position to the special position, rotation of the eccentric cam 66 is braked every time the roller 73 is inserted into each depression 84B1. Incidentally, as the posture of the eccentric cam 66 is changed from the initial position to the special position, a portion at the lower end side of the case 70 is pulled by the tensile spring ES (the tensile spring ES is contracted), and then, a posture of the second supporting body 65 is changed (refer to FIGS. 6 and 7).

Figure 3:
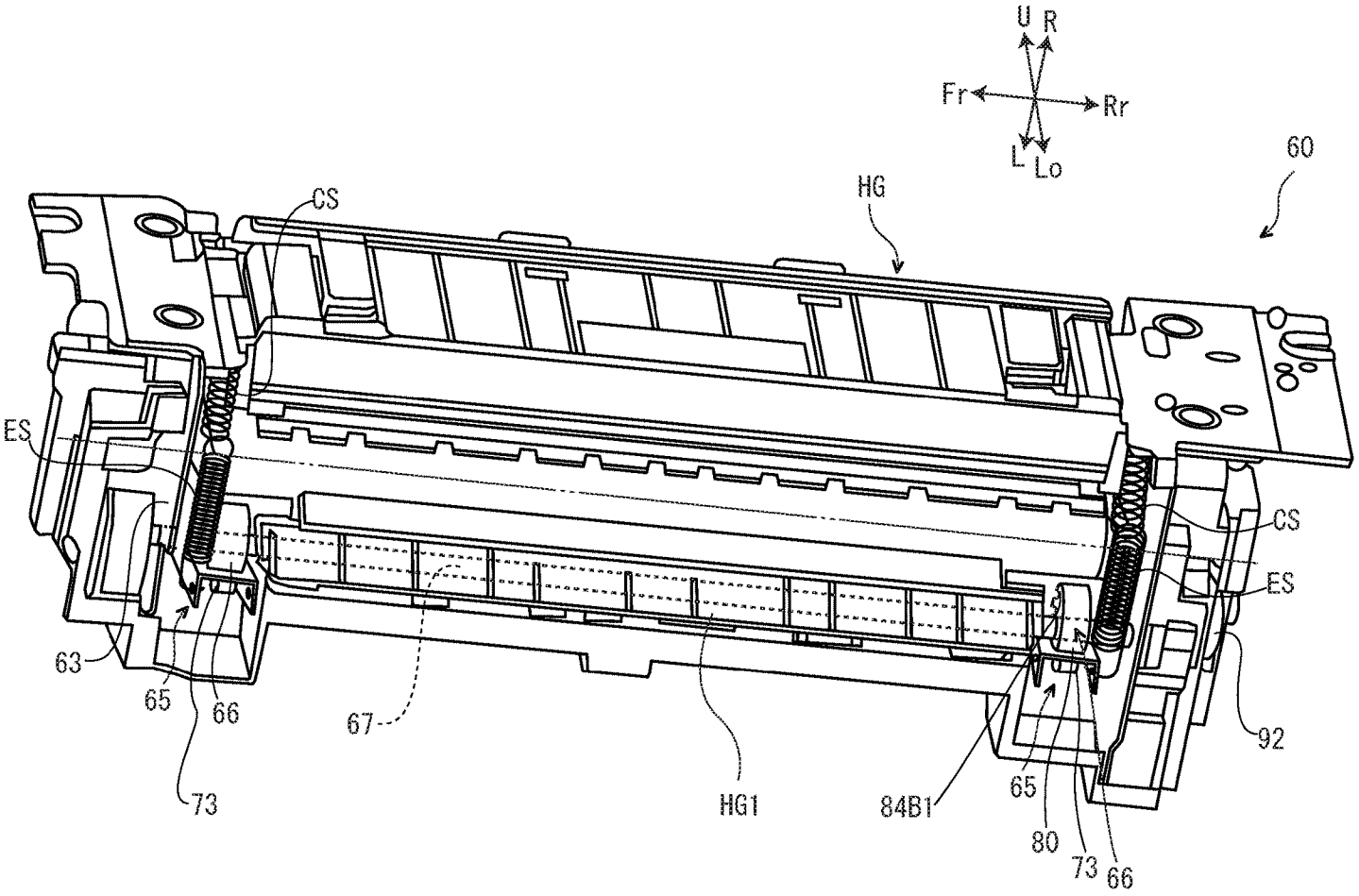
FIG. 3 is a perspective view showing the fixing device, as viewed from a right lower side, according to the embodiment of the present disclosure.
Figure 4:
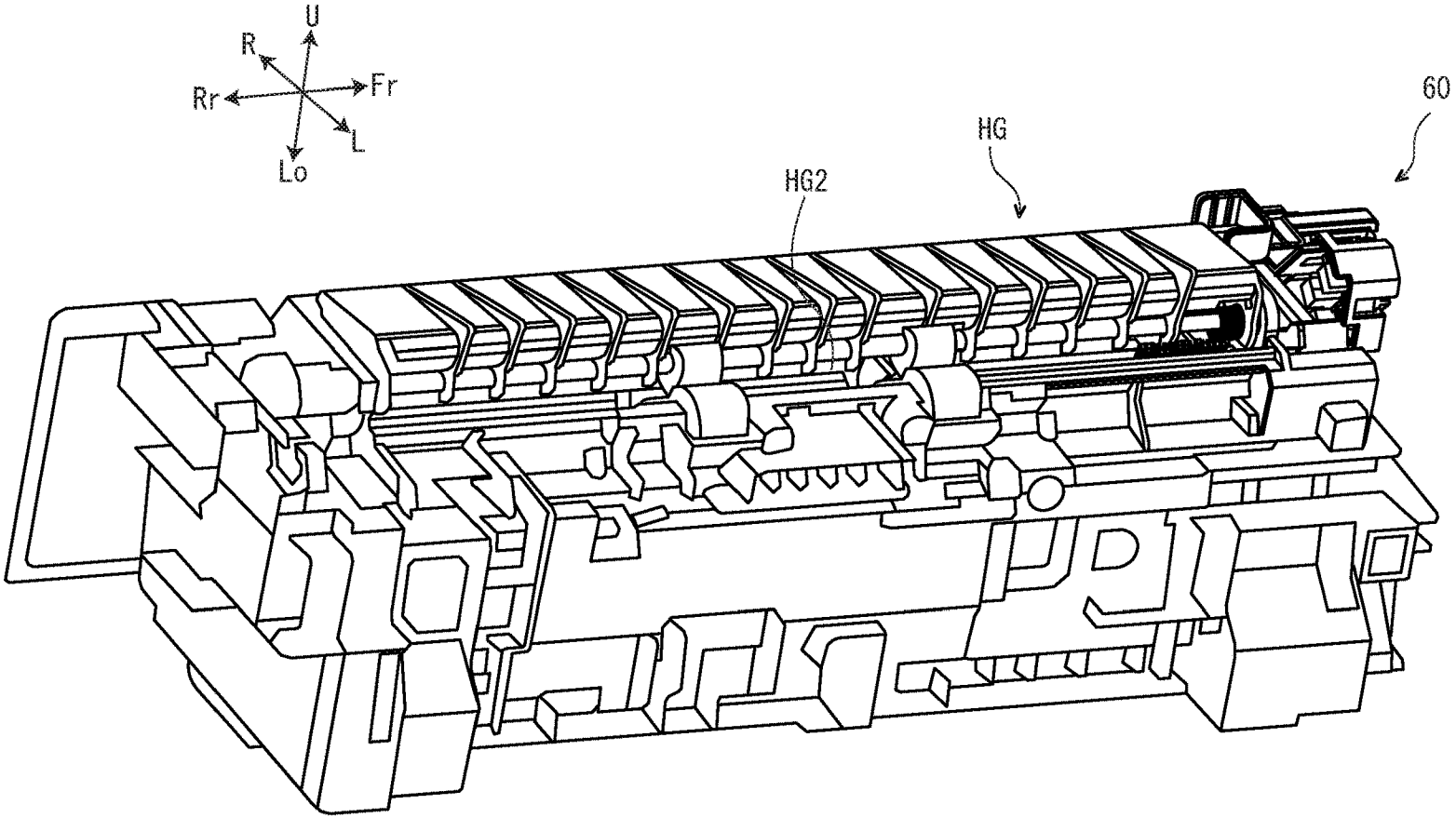
FIG. 4 is a perspective view showing the fixing device, as viewed from a left upper side, according to the embodiment of the present disclosure.

The driving part 68 has a function rotating the shaft 67, to which the eccentric cam 66 is fixed, around the axis. The driving part 68 is configured to include a driving source 90 (refer to FIG. 1) and a gear train 92 (refer to FIG. 3 and FIG. 3 illustrates a part of the gear train 92).

The driving source 90 has a function driving the gear train 92. The driving source 90 is, as one example, a motor. The gear train 92 is an assembly of a plurality of gears. The gear train 92 is connected to a gear (not shown) fixed to one end side of the shaft 67. Moreover, the gear train 92 is driven by the driving source 90 to rotate the shaft 67 around the axis. On other words, the gear train 92 is connected to the eccentric cam 66 via the shaft 67 and the gear of the shaft 67 to have a function transmitting a torque rotating the eccentric cam 66 around the axis to the eccentric cam 66.

Next, the changing operation of the nip pressure of the fixing device 60 will be described with reference to FIGS. 2, 6-8 and 10. Incidentally, operation of the fixing device 60 is carried out in the image forming operation of the above-described image forming apparatus 10. Moreover the posture of the eccentric cam 66 of the fixing device 60 is positioned at the above-described initial position (refer to FIG. 6) for a period the image forming operation (fixing operation) is not carried out.

The controlling part CU transmits a remote signal to the fixing device 60 when receiving the job data from the external device (not shown). Moreover, the controlling part CU drives the driving source (not shown) of the pressuring roller 62 to rotate the pressuring roller 62 around the axis by a predetermined rotation speed. According to this, the heating roller 61 is rotated by a predetermined rotation speed by following to the pressuring roller 62. In addition, in order to heat the heating roller 61, the heating source HT is activated.

Further, the controlling part CU, in accordance with the control flow shown in FIG. 2, decides at the decision step S10, whether or not the medium S as the image formed object is the plain paper. Then, if decision of the controlling part CU is positive (i.e. it is decided that the medium S is the plain paper), the controlling part CU selects the normal mode at the step S20 to carry out the fixing operation at a state of the initial position of the eccentric cam 66. FIG. 6 shows the fixing device 60 at the normal mode.

By contrast, if decision of the controlling part CU at the decision step S10 is negative (it is decided that the medium S is the envelope (one example of the cardboard)), the controlling part CU selects the special mode at the step S30. In such a case, the controlling part CU rotates the eccentric cam 66 in the clockwise direction as viewed from the front side with respect to the initial position as the standard (refer to FIG. 8), and then, makes the fixing device carry out the fixing operation. As described above, when the controlling part CU sets a mode of the fixing operation to any one of the normal mode and the special mode, and then, the medium S having the formed toner image is sent to the fixing device 60, the fixing device 60 fixes the toner image onto the medium S by any one mode of the above-described modes. FIG. 7 shows the fixing device 60 at a state that the second supporting body 65 is moved while the roller 73 comes into contact with the outer circumference face (the second face 84B) of the eccentric cam 66 when the nip pressure is changed from the normal mode to the special mode or the special mode to the normal mode.

Further, after the medium S having the formed image passes through the outlet HG2 of the fixing device 60, in a case of the normal mode, the controlling part 60 stops operation of all components to complete the fixing operation. Alternatively, after the medium S having the formed image passes through the outlet HG2 of the fixing device 60, in a case of the special mode, the controlling part 60 changes the posture of the eccentric cam 66 from the special position to the initial position (refer to FIG. 6) by the driving part 68, and then, stops operation of all components to complete the fixing operation.

Next the effect of the embodiment will be described with reference to the drawings.

Figure 11:
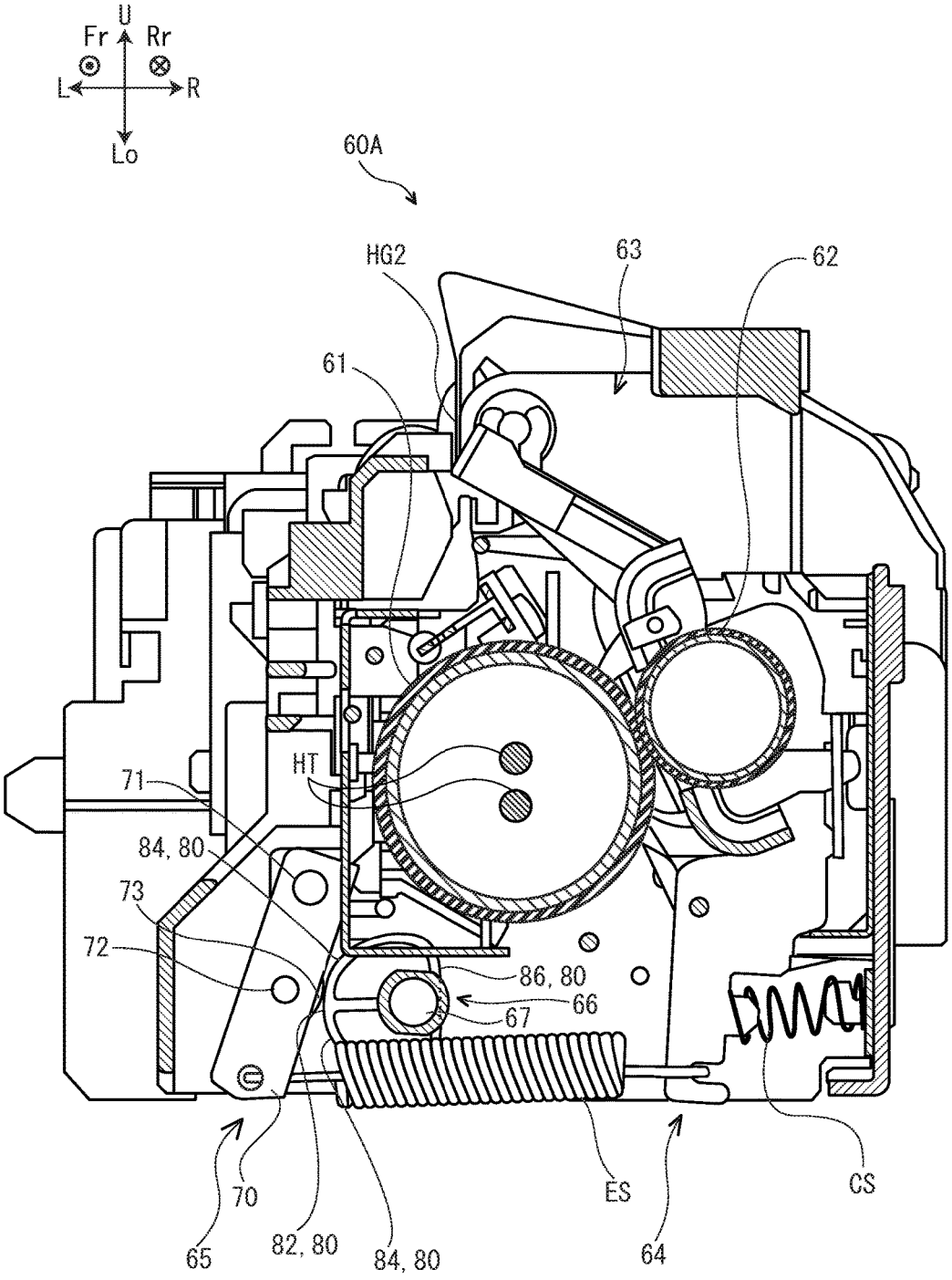
FIG. 11 is a partially sectional view (a sectional view as viewed from a longitudinal direction) showing a fixing device, in a normal mode, according to a comparative embodiment.

For example, in a case of a fixing device 60A of a comparative embodiment shown in FIG. 11, the eccentric cam 66A is not provided with the plurality of depressions 84B1 formed in the eccentric cam 66 of the present embodiment. Moreover, in a case where the fixing operation with respect to the envelope is carried out by using the fixing device 60A of the comparative embodiment, the fixing device 60A makes the roller 73 come into contact with an outer circumference face of the eccentric cam 66A in which no depression 84B1 is formed, and simultaneously, rotates the eccentric cam 66A around an axis, to carry out the changing operation of the nip pressure. In this case, in the fixing device 60A, the eccentric cam 66A is rotated by the driving device 68 to contract the tensile spring ES, but the tensile spring ES is pulled by the first supporting body 64, and accordingly, it is feared that the fixing device 60A overruns by looseness (backlash) in a rotation direction caused in the gear train 92 of the driving part 68. Subsequently, when the fixing device 60A overruns, impulsive sound according to this may occurs.

By contrast, in the fixing device 60 of the present embodiment, as a difference from the fixing device 60A of the comparative embodiment, in the second face 84B coming into contact with the roller 73 in a case where the posture of the eccentric cam 66 is changed from the initial position to the special position, the depressions 84B1 receiving insertion of the part (the roller 73) of the second supporting body 65 are formed (refer to FIG. 9). Therefore, since the roller 73 is inserted into the depression 84B1 while changing the posture from the initial position to the special position, the eccentric cam 66 is braked by the roller 73.

Therefore, in the fixing device 60 of the present embodiment, in comparison with a case no depression 84B1 receiving insertion of the part (the roller 73) of the second supporting body 65 is formed in the second face 84B coming into contact with the roller 73 while the posture of the eccentric cam 66 is changed from the initial position to the special position, the eccentric cam 66 is hard to overrun (overrunning of the eccentric cam 66 is restrained). Accordingly, in the fixing device 60 of the present embodiment, impulsive sound according to overrunning of the eccentric cam 66 is hard to occur (or even if impulsive sound occurs, its sound pressure may be reduced).

In addition, in the fixing device 60 of the present embodiment, structure braking the eccentric cam 66 as the tensile spring ES is contracted with respect to the second supporting body 65 and the eccentric cam 66 can be actualized by simple structure to the extent of forming the depression 84B1. Therefore, in the fixing device 60 of the present embodiment, it is possible to make overrunning of the eccentric cam 66 hard by the simple structure. On other words, it is possible to restrain overrunning of the eccentric cam 66 when the tensile spring ES is contrasted by rotating the eccentric cam 66 with the driving device 68.

Figure 12A:
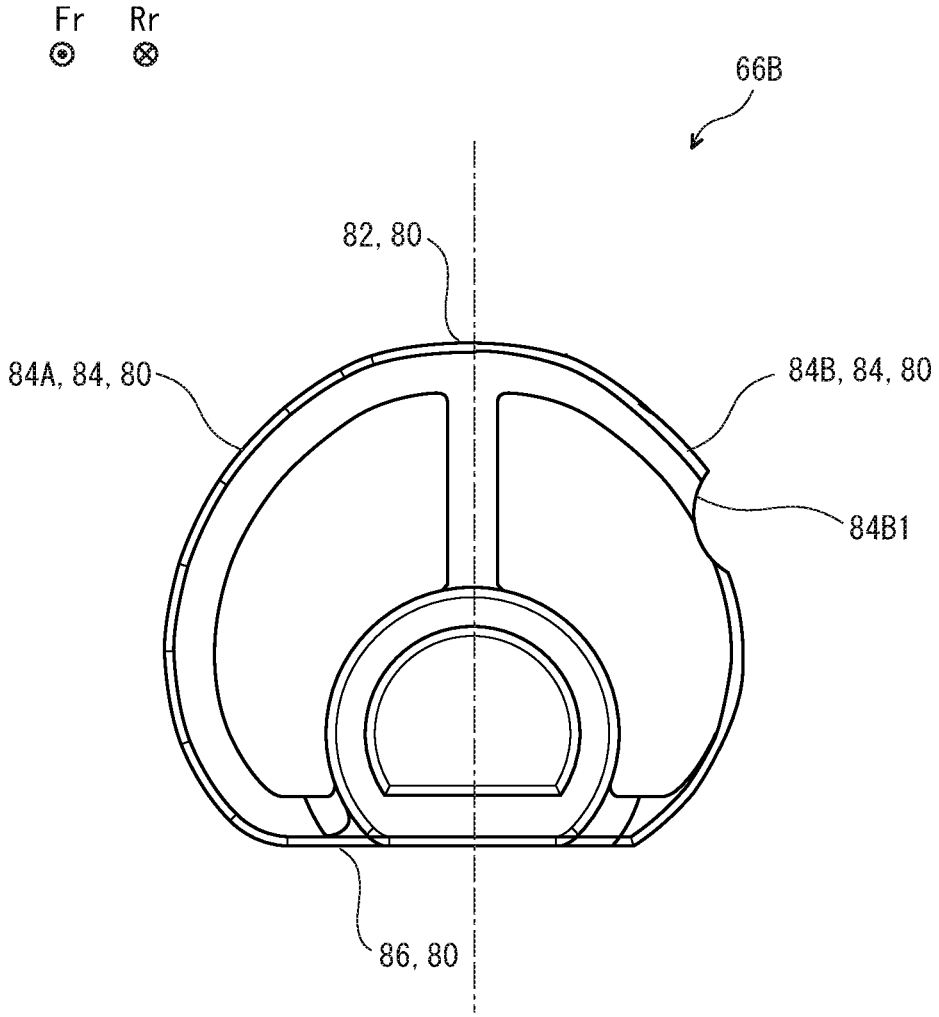
FIG. 12A is a front view showing an eccentric cam composing a fixing device according to a first modified example.

Moreover, in the fixing device 60 of the present embodiment, the depressions 84B1 formed in the eccentric cam 66 are plural. Therefore, in the fixing device 60 of the present embodiment, in comparison with a case where the depression 84B1 is single (refer to an eccentric cam 66B of a first modified example in FIG. 12A), the eccentric cam 66 is hard to overrun (overrunning of the eccentric cam 66 is restrained). Accordingly, in the fixing device 60 (and the image forming apparatus 10) of the present embodiment, in comparison with the case where the depression 84B1 is single, impulsive sound according to overrunning of the eccentric cam 66 is hard to occur (or even if impulsive sound occurs, its sound pressure may be reduced). Incidentally, the modified example shown in FIG. 12A is depend on technical scope of the present disclosure because of having structure achieving an effect hardly causing overrunning of the eccentric cam 66 in comparison with s case of the above-mentioned comparative embodiment (FIG. 11).

Although, as described above, the present disclosure was described by citing the present embodiment as an example, the present disclosure is not restricted by the present embodiment. For example, in the technical scope of the present disclosure, the following embodiment is included.

For example, the fixing device 60 of the present embodiment was described so that the heating roller 61 is supported to the lateral plate 63 and the pressuring roller 62 is supported to the first supporting body 64. However, those supporting the rollers may be reversed.

Moreover, the fixing device 60 of the present embodiment was described so that one example of the heating body is the heating roller 61. However, one example of the heating body may be an endless belt.

Figure 12B:
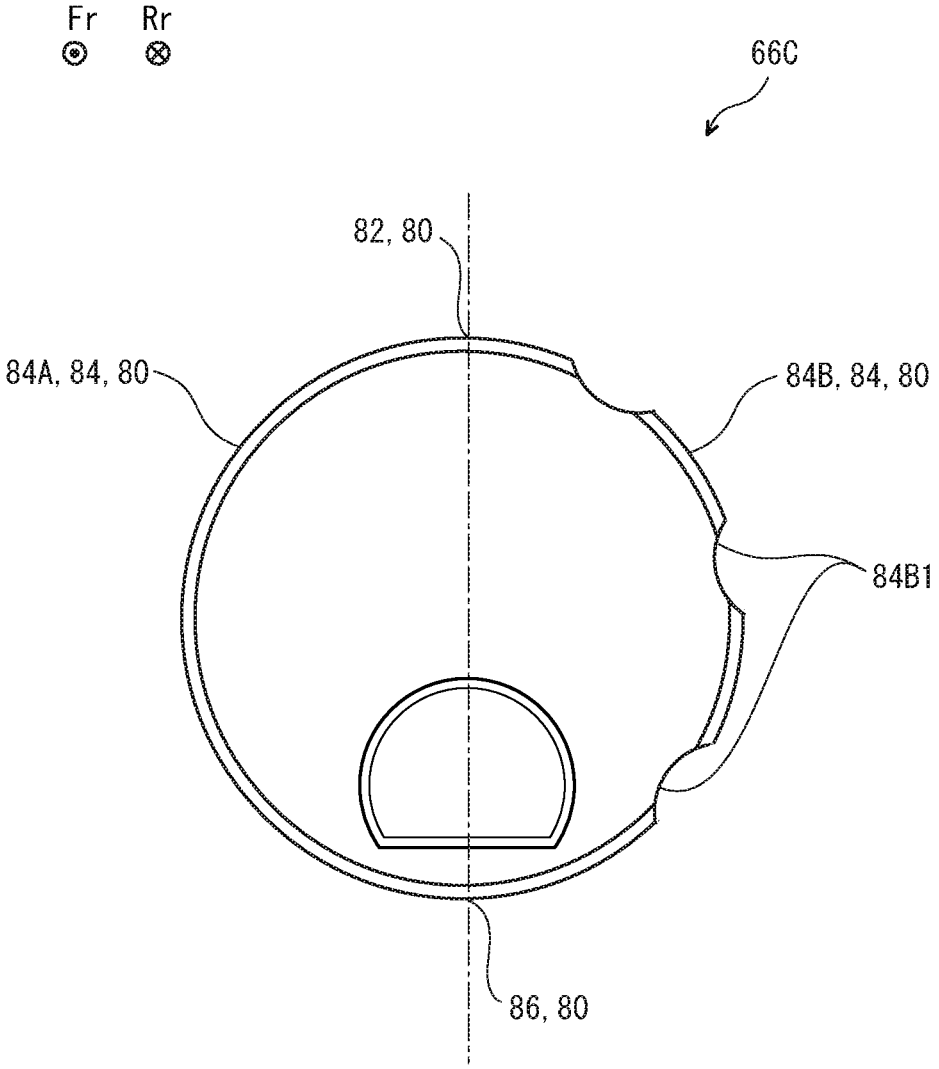
FIG. 12B is a front view showing an eccentric cam composing a fixing device according to a second modified example.

Further, the fixing device 60 of the present embodiment was described so that the eccentric cam 66 is the semi-elliptic shape member (refer to FIG. 9). However, as the eccentric cam 66C of a second modified example in FIG. 12B, it may be configured so that the depressions 84B1 are formed in a perfect circular member as viewed from a depth direction. The perfect circular eccentric cam 66C has a third face 86 as the second portion at a side of a rotation axis positioned to one side in a symmetry axis and a first face 82 as the first portion at an opposite side to the third face 86 in a symmetry axis direction. In addition, the perfect circular eccentric cam 66C has a pair of second faces 84 ranging from the first face 82 to the third face 86 and at least one depression 84B1 on one of the pair of second faces 84.

The configuration of the present disclosure may be applied to any one of various image forming apparatuses, such as a printer, a copying machine, a facsimile or a multifunction peripheral.

Incidentally, the above-description of the embodiments was described about one example of the fixing device and the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. A fixing device comprising:

a heating body being rotated and heating a medium on which a toner image is formed;

a pressuring body forming a nip with the heating body, being rotated and pressuring the medium passing through the nip;

a lateral plate supporting one body of the heating body and the pressuring body rotatably;

a first supporting body swingably supported to the lateral plate and supporting other body being against the one body rotatably;

a second supporting body swingably supported to the lateral plate and including a rotatable roller;

a tensile spring connected between the first supporting body and the second supporting body at its both ends to pull the first supporting body to a side of the second supporting body;

an eccentric cam rotatably supported at a position between the first supporting body and the second supporting body in the lateral plate, making its outer circumference face come into contact with the roller, and being rotated to change a posture of the second supporting body and to extend and contract the tensile spring, and thereby, changing a nip pressure of the nip to a first pressure or a second pressure lower than the first pressure; and a driving part including a gear train connected to the eccentric cam to transmit torque rotating the eccentric cam to the eccentric cam and a driving source driving the gear train;

wherein, in the outer circumference face, in a portion coming into contact with the roller between a first portion making the first pressure of the nip pressure and a second portion making the second pressure of the nip pressure, at least one depression receiving insertion of the roller is formed.

2. The fixing device according to claim 1, wherein the at least one depression includes a plurality of depressions.

3. An image forming apparatus comprising:

a forming part forming a toner image onto a medium; and the fixing device according to claim 2 to fix the toner image formed on the medium by the forming part to the medium.

4. The fixing device according to claim 1, wherein the driving part rotates the eccentric cam so as to make the first pressure of the nip pressure in a normal mode in a case where the medium is a plain paper, and rotates the eccentric cam so as to make the second pressure of the nip pressure in a special mode in a case where the medium is not the plain paper.

5. An image forming apparatus comprising:

a forming part forming a toner image onto a medium; and the fixing device according to claim 4 to fix the toner image formed on the medium by the forming part to the medium.

6. The fixing device according to claim 1, wherein the eccentric cam is formed in a semi-elliptic shape in a line symmetry as a portion cut out along a minor axis of an ellipse, has the second portion at a side of the minor axis, has the first portion at an opposite side to the second portion in a symmetry axis direction, and has the at least one depression formed in any one of a pair of faces ranging from the first portion to the second portion.

7. An image forming apparatus comprising:

a forming part forming a toner image onto a medium; and the fixing device according to claim 6 to fix the toner image formed on the medium by the forming part to the medium.

8. The fixing device according to claim 1, wherein the eccentric cam is formed in a perfect circular shape.

9. An image forming apparatus comprising:

a forming part forming a toner image onto a medium; and the fixing device according to claim 8 to fix the toner image formed on the medium by the forming part to the medium.

10. An image forming apparatus comprising:

a forming part forming a toner image onto a medium; and the fixing device according to claim 1 to fix the toner image formed on the medium by the forming part to the medium.

* * * * *